US007097557B2

(12) United States Patent
Kutschman

(10) Patent No.: US 7,097,557 B2
(45) Date of Patent: Aug. 29, 2006

(54) INSULATED CRAWLSPACE VENT APPARATUS, AND METHODS OF INSTALLING SAME

(76) Inventor: Richard Frederick Kutschman, 7450 Cedar Lake Rd., Oscoda, MI (US) 48750

( * ) Notice: Subject to any disclaimer, the term of this patent is extended or adjusted under 35 U.S.C. 154(b) by 0 days.

(21) Appl. No.: 10/984,427

(22) Filed: Nov. 9, 2004

(65) Prior Publication Data

US 2005/0113019 A1 May 26, 2005

Related U.S. Application Data

(60) Provisional application No. 60/518,846, filed on Nov. 10, 2003.

(51) Int. Cl.
*F24F 13/06* (2006.01)

(52) U.S. Cl. ..... 454/276; 454/275

(58) Field of Classification Search ..... 454/271, 454/276, 273, 274

See application file for complete search history.

(56) References Cited

U.S. PATENT DOCUMENTS

| | | | | |
|---|---|---|---|---|
| 4,469,018 | A * | 9/1984 | Taulman | 454/276 |
| 4,676,145 | A * | 6/1987 | Allred | 454/276 |
| 4,699,045 | A * | 10/1987 | Hensley | 454/313 |
| 4,711,160 | A * | 12/1987 | Witten et al. | 454/283 |
| 4,953,450 | A * | 9/1990 | Remondino | 454/239 |
| 5,460,572 | A * | 10/1995 | Waltz et al. | 454/273 |
| 5,620,368 | A * | 4/1997 | Bates et al. | 454/186 |
| 6,468,054 | B1 * | 10/2002 | Anthony et al. | 417/360 |
| 6,817,942 | B1 * | 11/2004 | Betz | 454/271 |

* cited by examiner

*Primary Examiner*—Derek S. Boles
(74) *Attorney, Agent, or Firm*—Weiner & Burt, P.C.; Irving M. Weiner; Pamela S. Burt

(57) ABSTRACT

An insulated crawlspace vent to provide airflow in a crawlspace in the summer and insulate it in the winter. An aluminum extrusion built as a picture frame is glued to the opening in the foundation of the crawlspace. An insulated door closes from the outside and is latched shut to keep out the cold.

1 Claim, 1 Drawing Sheet

INSULATED CRAWLSPACE VENT APPARATUS, AND METHODS OF INSTALLING SAME

The present patent application claims priority from and is based on U.S. Provisional Patent Application Ser. No. 60/518,846 filed Nov. 10, 2003, the entire contents of which are incorporated herein by reference thereto.

The present invention relates generally to certain new and useful improvements in crawlspace vents, and methods of installing same.

More particularly, the present invention relates to a novel insulated crawlspace vent apparatus, and methods of installing same.

BACKGROUND OF THE INVENTION

Crawlspace vents are used to ventilate the space between the house and the ground. The conventional vents used by masons are mortared in place and are usually flush to the outside cinder block.

In the winter, or in preparation for the winter, many homeowners crawl through their spider-infested crawlspaces and place blanket insulation in back of the conventional crawlspace vent to aid in limiting heat loss. Many homeowners also put a piece of foam insulation in front of the conventional vent, and an additional cement or cinder block.

The present invention alleviates the aforementioned inconveniences and problems.

The prior, but not necessarily relevant, art is exemplified by the following United States patents.

Koontz U.S. Pat. No. 3,863,553, entitled "COMBINATION INSULATION STOP AND VENTILATION BAFFLE, discloses a combination ventilation baffle and insulation stop for use in building structures to provide air passage to the space between the roof and the ceiling. When installed, the apparatus defines an air passage between its central section and the structure roof. The passage may be selectively sealed through use of a pivotable tab during application of insulation, and then subsequently reopened thereby insuring proper ventilation.

Koontz U.S. Pat. No. 4,184,416, entitled "COMBINATION THERMAL INSULATION STOP AND VENTILATION BAFFLE ARTICLE", discloses an insulation stop and ventilation baffle for assisting in the installation of loose fiber or particulate thermal insulation in the crawlspace or attic between a ceiling and roof of a building structure. The article is constructed of a rather stiff sheet material having parallel side fold lines formed therein adjacent to and spaced inwardly from parallel side edges. The fold lines define side sections that may be folded upwardly to receive the ends of an elongated flexible rod. The baffle will prevent seepage of insulation into the air passage leading to ventilators in the eaves and allow a maximum buildup of insulation above the exterior wall plates.

Buonaiuto, Sr. et al. U.S. Pat. No. 5,890,845, entitled "METHOD AND MEANS FOR SEALING CRAWLSPACE SURFACES", discloses a method of sealing the entire surfaces of a crawlspace and other areas difficult to access in a structure, by which a uniformly thick layer of a quick drying and moldable lightweight concrete is flowed over the entire surfaces to be covered in a uniform thickness sufficient to seal the surface.

It is a desideratum of the present invention to avoid the animadversions of the conventional vent devices and the above-described prior art techniques and devices.

SUMMARY OF THE INVENTION

The present invention provides an insulated crawlspace vent apparatus, comprising: a frame structure to be installed in an opening of a wall in a crawlspace; a screen structure permanently secured to said frame structure covering said opening in said wall in said crawlspace; and a foam insulating panel removably secured within said frame structure and positioned toward an exterior surface of said wall of said crawlspace.

The present invention also provides a method of installing an insulated crawlspace vent apparatus comprising the steps of: removing an existing vent structure in a crawlspace; and installing a new insulated crawlspace vent apparatus in the opening provided by removing the old vent device, and adhesively securing the new insulated crawlspace vent apparatus therein The present invention provides a new and useful insulated crawlspace vent apparatus, comprising: a frame structure to be installed in an opening in a wall of a crawlspace; a screen structure permanently installed in said opening; and a foam insulating panel removably secured within said frame structure and positioned toward the exterior of said wall of said crawlspace.

The present invention also provides a method of installing said insulated crawlspace vent apparatus, comprising the steps of: removing the existing vent structure in a crawlspace; and installing the above-described novel insulated crawlspace vent apparatus in the opening provided by removing the old vent device and adhesively securing the insulated crawlspace vent apparatus therein.

It is an object of the present invention to provide a unique insulated crawlspace vent apparatus which provides airflow in the crawlspace in the summer, and insulates the crawlspace in the winter.

Another object of the present invention is to provide an insulated crawlspace vent apparatus as described hereinabove, which is formed as a picture frame and glued to the foundation of the building.

Another object of the present invention is to provide a novel and unique insulated crawlspace vent apparatus as described hereinbaove, which includes an insulated door which closes from the outside and is latched shut to keep out the cold weather.

A further object of the present invention is to provide a novel and unique insulated crawlspace vent apparatus as described hereinabove, wherein such apparatus is fabricated from any suitable material, such as, for example, plastic or an aluminum extrusion.

The present invention possesses many other advantages and features which will become more apparent to those persons skilled in this particular area of technology and to other persons after having been exposed to the detailed description of one exemplary preferred embodiment of the present invention as set forth hereinbelow in conjunction with the accompanying drawings.

DETAILED DESCRIPTION

Figure 1:
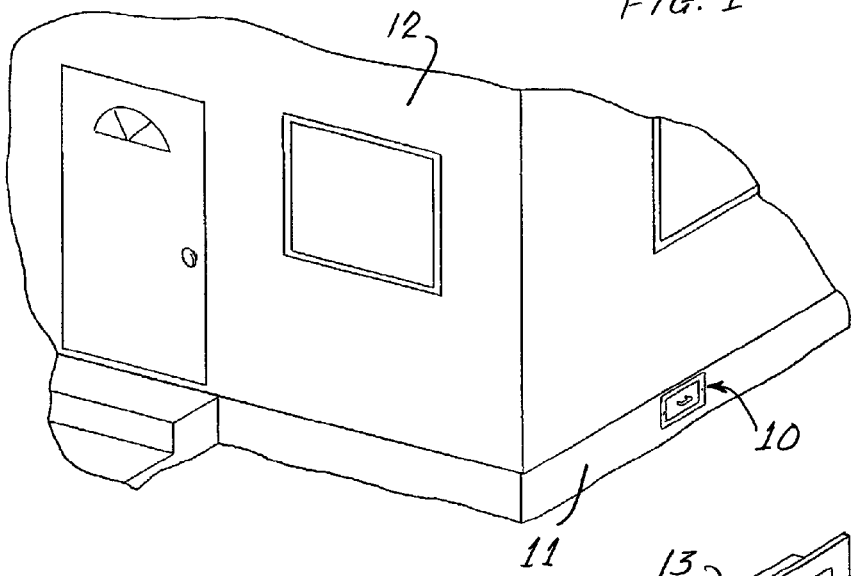
FIG. 1 is a perspective illustration of a portion of a house showing a preferred embodiment of the present invention installed therein.

With reference to FIG. 1, there is shown an insulated crawlspace vent apparatus 10 in accordance with a preferred embodiment of the present invention installed in the block 11 forming the crawlspace of a home 12.

Figure 2:
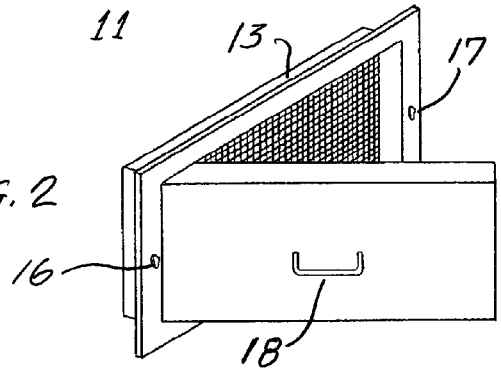
FIG. 2 illustrates an enlarged perspective view of a preferred embodiment of the present invention.
Figure 3:
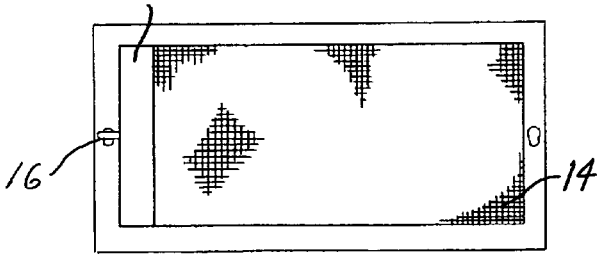
FIG. 3 depicts a front elevational view of the FIG. 2 embodiment showing the foam insulation panel pivoted to an open position.
Figure 4:
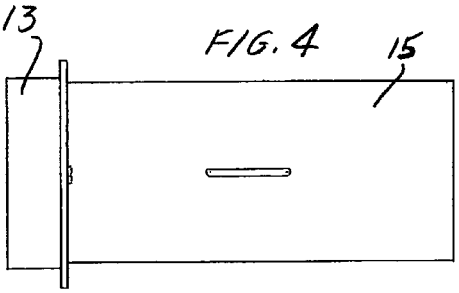
FIG. 4 illustrates a side elevational view of the FIG. 3 embodiment.

With reference to FIGS. 2, 3 and 4, the novel insulated crawlspace vent apparatus 10 includes a frame structure 13 having a screen structure 14 permanently installed therein. The screen structure 14 is positioned towards the interior of the crawlspace and of vent apparatus 10 to keep out insects and other unwanted creatures and materials.

Preferably, but not necessarily, the frame structure 13 may be fabricated out of plastic or an aluminum extrusion.

The insulated crawlspace vent apparatus 10 also includes an insulated door 15 in the form of a foam insulation panel which is removable from the insulated crawlspace vent apparatus 10 for summer use. To facilitate this, the insulation panel/door 15 may be provided with a handle device 18.

The frame structure 13 is provided with one or more holding clips 16 and 17 which permit the foam insulation panel/door 15 to be held in the crawlspace vent apparatus 10, or selectively removed therefrom.

The unique insulated crawlspace vent apparatus 10 may be used for new construction or retrofitted after market.

Where a conventional old vent device has already been installed for a crawlspace, the old vent device can be punched out by the use of a hammer or other suitable device to leave an opening in the crawlspace wall or cinder block 11.

The insulated crawlspace vent apparatus 10 in accordance with the present invention can be installed by applying a suitable adhesive, such as a construction adhesive, to the frame structure 13 and then pushing the entire insulated crawlspace vent apparatus 10 into the opening left by the old conventional vent device.

Once installed, a mere half turn of the holding clips 16 and 17 allows the foam insulation panel/door 15 to be removed for summer use, or installed for winter use.

Preferably, but not necessarily, the insulated panel/door 15 can include two inch foam.

In accordance with a preferred embodiment of the present invention, the insulated crawlspace vent apparatus 10 may include an aluminum extrusion 13 built as a picture frame and glued to the foundation 11 of the house 12. The insulated door 15 closes from the outside and may be latched shut to keep out the cold.

There has been illustrated in the accompanying drawings and described hereinbaove only one unique and novel embodiment of the present invention which can be practiced and constructed in many different configurations, arrangements of components, sizes, and shapes.

It should be understood that many changes, modifications, variations, and other uses and applications will become apparent to those persons skilled in this particular area of technology and to others after having been exposed to the present patent specification and accompanying drawings.

Any and all such changes, modifications, variations and other uses and applications which do not depart from the spirit and scope of the present invention are therefore covered by and embraced within the present invention and the patent claims set forth hereinbelow.

The invention claimed is:

1. An insulated crawlspace vent apparatus, comprising:

a rigid unitary frame structure to be installed in an opening of a foundation wall in a crawlspace;

said rigid unitary frame structure comprises a four-sided structure forming a complete rectangle;

a screen structure permanently secured to said rigid unitary frame structure covering said opening in said foundation wall in said crawlspace;

a foam insulating panel being made entirely of foam and being removably secured within said rigid unitary frame structure and being positioned toward an exterior surface of said foundation wall of said crawlspace;

said rigid unitary frame structure is formed in the shape of a picture frame which is glued to said foundation wall in said opening;

said screen structure is positioned towards an interior of said crawlspace and of said vent apparatus to keep out insects and other unwanted creatures and materials;

said foam insulating panel is provided with a handle device to facilitate removal of said foam insulating panel from said insulated crawlspace vent apparatus;

one or more holding clips which permit said foam insulating panel to be removed from said rigid unitary frame structure for summer use or installed for winter use; and said foam insulating panel closes from the outside and may be latched shut to keep out the cold.

* * * * *